US006530809B2

(12) United States Patent
Handa et al.

(10) Patent No.: US 6,530,809 B2
(45) Date of Patent: Mar. 11, 2003

(54) MODULAR JACK

(75) Inventors: Shinsuke Handa, Osaka (JP); Satoru Watanabe, Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/994,826

(22) Filed: Nov. 28, 2001

(65) Prior Publication Data

US 2002/0064998 A1 May 30, 2002

(30) Foreign Application Priority Data

Nov. 28, 2000 (JP) ..... 2000-361385

(51) Int. Cl.[7] ..... H01R 13/648
(52) U.S. Cl. ..... 439/607; 439/95
(58) Field of Search ..... 439/607, 95, 98, 439/108, 696

(56) References Cited

U.S. PATENT DOCUMENTS 5,562,496 A * 10/1996 Benjamin et al. ..... 439/108
5,697,799 A * 12/1997 Consoli et al. ..... 439/181
5,718,605 A * 2/1998 Morikawa et al. ..... 439/108
6,113,426 A * 9/2000 Lin ..... 439/607
6,155,878 A * 12/2000 Chen ..... 439/108

* cited by examiner

*Primary Examiner*—Tulsidas Patel
(74) *Attorney, Agent, or Firm*—Oblon, Spivak, McClelland, Maier & Neustadt, P.C.

(57) ABSTRACT

A portion of a casing having insulating performance is covered by a shell made of metal for electromagnetic shielding. A reinforcement tab formed separately from the shell includes a leg portion to be soldered above a printed wiring board. The reinforcement tab and the shell are engaged with each other via an engaging projection. The reinforcement tab is constituted by coating a surface of a pressed product with a conductive plated coating. A rupture face of the reinforcement tab is not exposed.

5 Claims, 11 Drawing Sheets

MODULAR JACK

BACKGROUND OF THE INVENTION

1. Field of the Invention

The present invention relates to a modular jack mounted to an apparatus such as a notebook type personal computer, a game machine or the like and mated with a modular plug corresponding thereto.

2. Description of the Related Art

According to a modular jack of this kind, a surrounding of a casing made of synthetic resin is covered by a shell made of metal for electromagnetic shielding.

Normally, the shell is formed by pressing a sheet metal member. The shell is provided with a front plate constituting a square ring shape covering a front plate of a casing and side plates covering respective side walls of the casing. Further, reinforcement tabs extended along a conductive portion on a printed wiring board are respectively extended integrally from a pair of the opposed side plates of the shell and the respective reinforcement tabs are fixed to the conductive portion by soldering.

In this way, the conventional shell is constructed by a comparatively complicated structure integrally provided with the reinforcement tabs and therefore, there is a drawback described below.

That is, the shell is, for example, plated with tin for rust prevention. When the shell having the above-described integrated structure is assumedly formed by pressing after plating the sheet metal member (That is, a case of so-to-speak previous plating), a rupture face by pressing is exposed at a portion of the reinforcement tab. The plating is not carried out at the portion and therefore, there is a concern that wettability of solder is poor and fixing by soldering becomes uncertain.

Conversely, when pressing is carried out previously and plating is carried out by dipping a complicated structure integrally formed with the shell and the reinforcement tabs into a plating tank (That is, a case of so-to-speak post plating), there is a concern that the shells having the complicated structure are tangled with each other and deformed. When the plating step is going to be carried out such that the above-described situation is avoided, operational efficiency is deteriorated and fabrication cost is increased.

SUMMARY OF THE INVENTION

The invention has been carried out in view of the above-described problem and it is an object of the invention to provide a modular jack which is fixed to a printed wiring board with certainty and inexpensive.

In order to achieve the above-described object, according to a first aspect of the invention, there is provided a modular jack characterized in including: a casing having an insulating performance arranged above a printed wiring board; a shell made of metal for electromagnetic shielding covering at least a portion of the casing; and a reinforcement tab made of metal and provided separately from the shell for fixing the casing onto the printed wiring board, wherein the reinforcement tab includes a side plate fixed to a side wall of the casing and engaged with a side wall of the shell and a leg portion extended from the side plate along a surface of the printed wiring board and soldered to a conductive portion of the surface of the printed wiring board, and wherein the side wall of the shell and the side plate of the reinforcement tab are electrically conducted via an engaging portion, and wherein the reinforcement tab is constituted by coating a surface of a pressed product with a conductive plated coating.

According to the invention, the reinforcement tab can be constituted by a part having a simple structure separately from the shell and therefore, even when plating is carried out after pressing (post plating), pressed products are not tangled with each other in a plating tank, therefore, so-to-speak post plating can be carried out without lowering operational efficiency in plating. By carrying out the post plating, rupture face in pressing is coated by the plated coating and therefore, as a result of improving wettability of solder of the portion, the reinforcement tab is fixed with certainty. Further, the shell and the reinforcement tab are engaged with each other to thereby ensure electric conduction and therefore, for example, when the shell is connected to a chassis of an apparatus and the reinforcement tab is connected to the printed wiring board, a ground through path for matching levels of the chassis and the printed wiring board can be achieved by a simple structure by way of the shell and the reinforcement tab. Further, the shell can also be prevented from being drawn from the casing by the reinforcement tab.

According to a second aspect of the invention, there is provided the modular jack according the first aspect, characterized in that the engaging portion includes an engaging projected portion formed at either one of the side wall of the shell and the side plate of the reinforcement tab and engaged with the other thereof to thereby prevent the shell from being detached from the casing. According to the invention, the shell can be prevented from being detached with certainty.

According to a third aspect of the invention, there is provided the modular jack according to the first or second aspect, characterized in that the shell includes the side wall having an elastic piece for grounding. According to the invention, for example, when the modular jack is set to a containing recessed portion of the apparatus, the elastic piece is brought into elastic contact with a predetermined contact portion in the containing recess portion and contact for grounding can easily be constituted.

DETAILED DESCRIPTION OF THE PREFERRED EMBODIMENTS

An explanation will be given of preferable embodiments of the invention in reference to the attached drawings.

Figure 1:
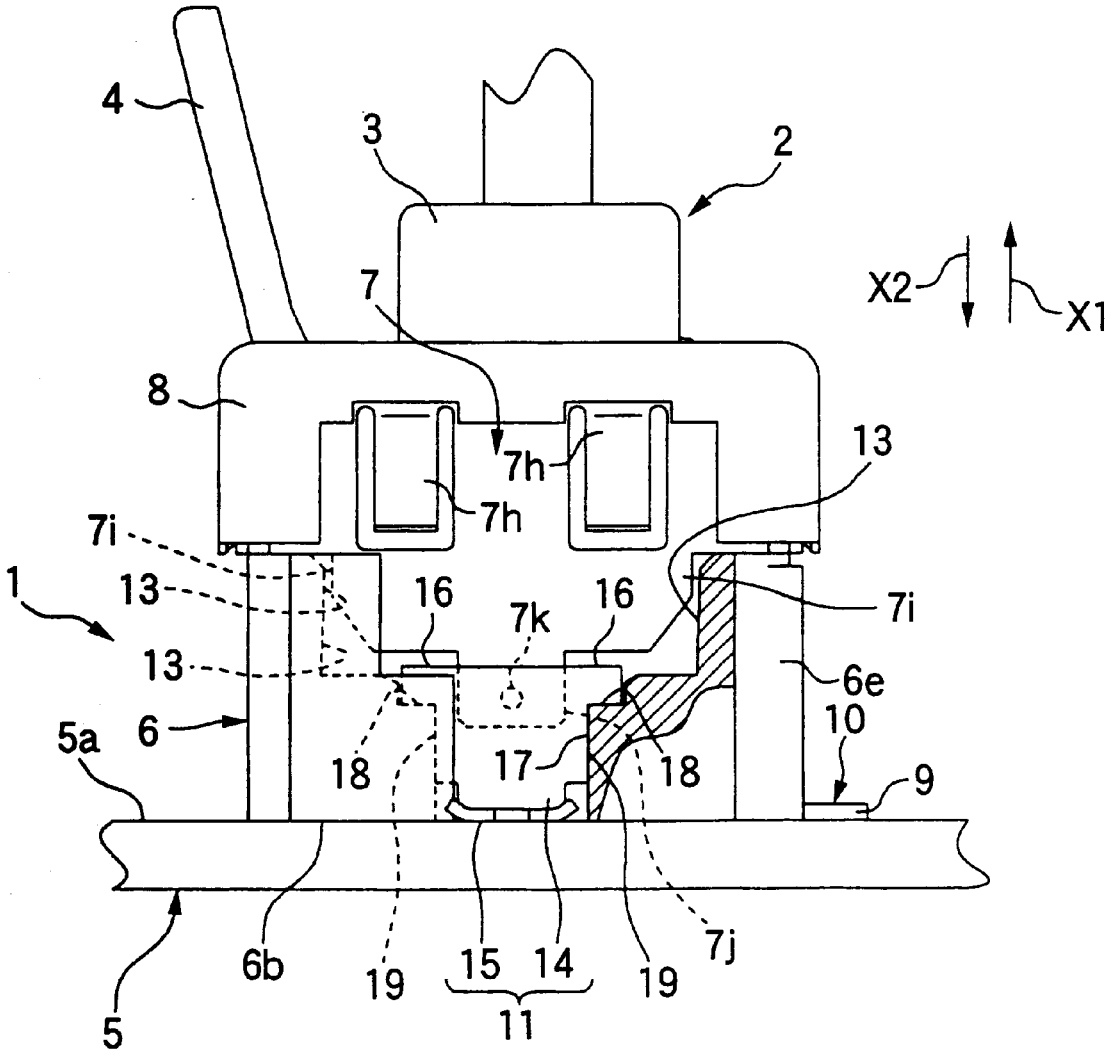
FIG. 1 is a partially broken side view showing a state of attaching a modular plug to a modular jack according to an embodiment of the invention.

FIG. 1 is an outline side view showing a state in which a modular plug is mounted to a modular jack according to an embodiment of the invention. In reference to FIG. 1, the modular jack 1 is for connecting a modular plug 2 of a standardized product. The modular plug 2 is provided with a plug main body 3 for holding a plurality of contact pins (not illustrated) and an elastically deformable engaging lever 4 supported by the plug main body 3 in a cantilever shape.

Although according to the embodiment, an explanation will be given in conformity to an example of a vertical modular jack in which a front side of the modular jack 1 constitutes an upper direction X1 and a rear side thereof constitutes a lower direction X2, the invention is not limited thereto but the invention may be applied to a horizontal modular jack in which a front side of the modular jack is directed in a horizontal direction.

The modular jack 1 is provided with a casing 6 having an insulating performance made of, for example, synthetic resin and arranged above a printed wiring board 5; a shell 7 made of a metal for electromagnetic shielding for covering at least a portion of the casing 6; an insulating cover 8 made of, for example, synthetic resin for covering at least a portion of the shell 7; a plurality of contact pin 10 respectively having lead portions 9; and a reinforcement tab 11 soldered to a conductive portion above the printed wiring board 5 while reinforcing the casing 6.

Figure 2:
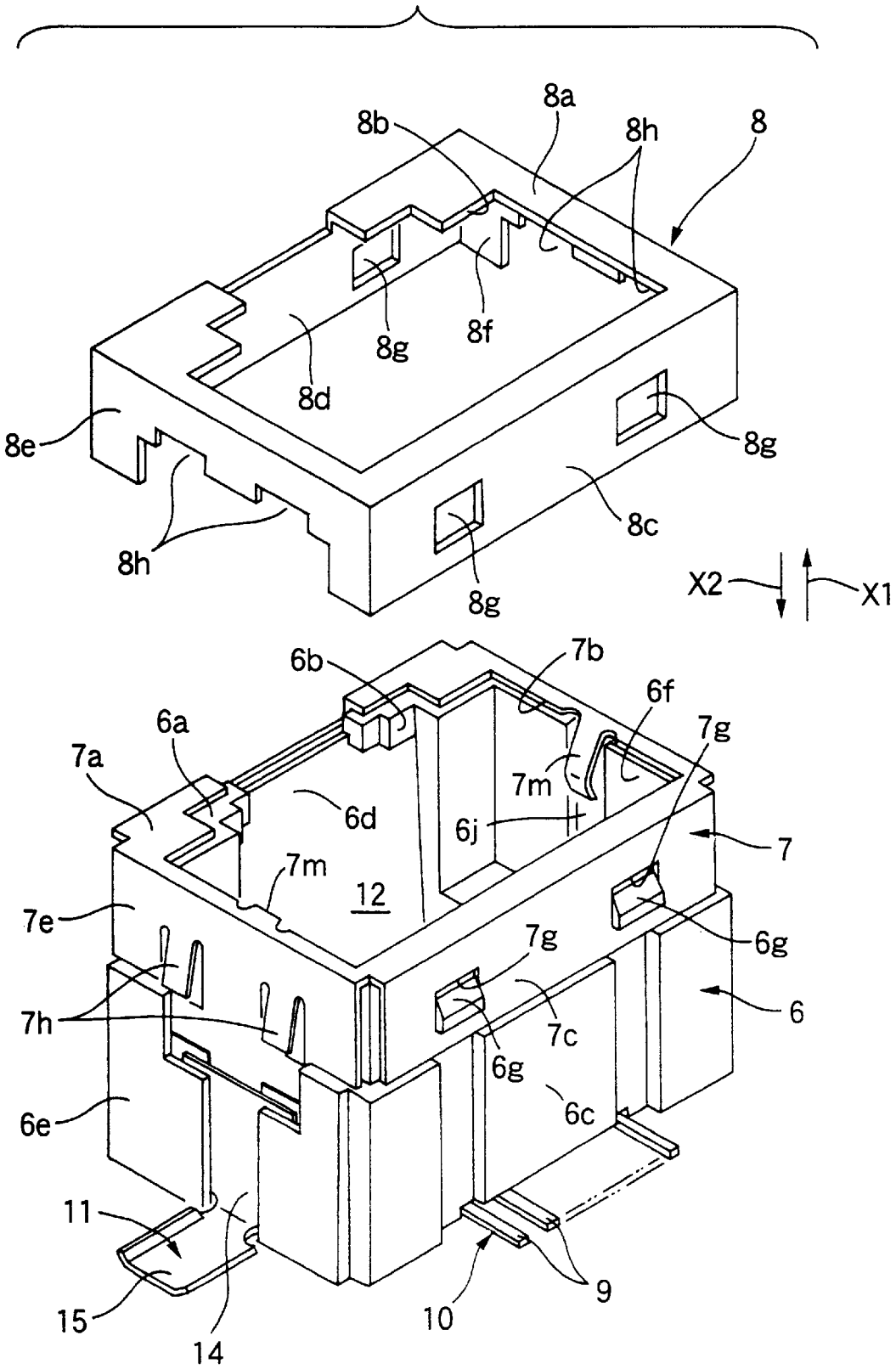
FIG. 2 is a disassembled perspective view of the modular jack.
Figure 3:
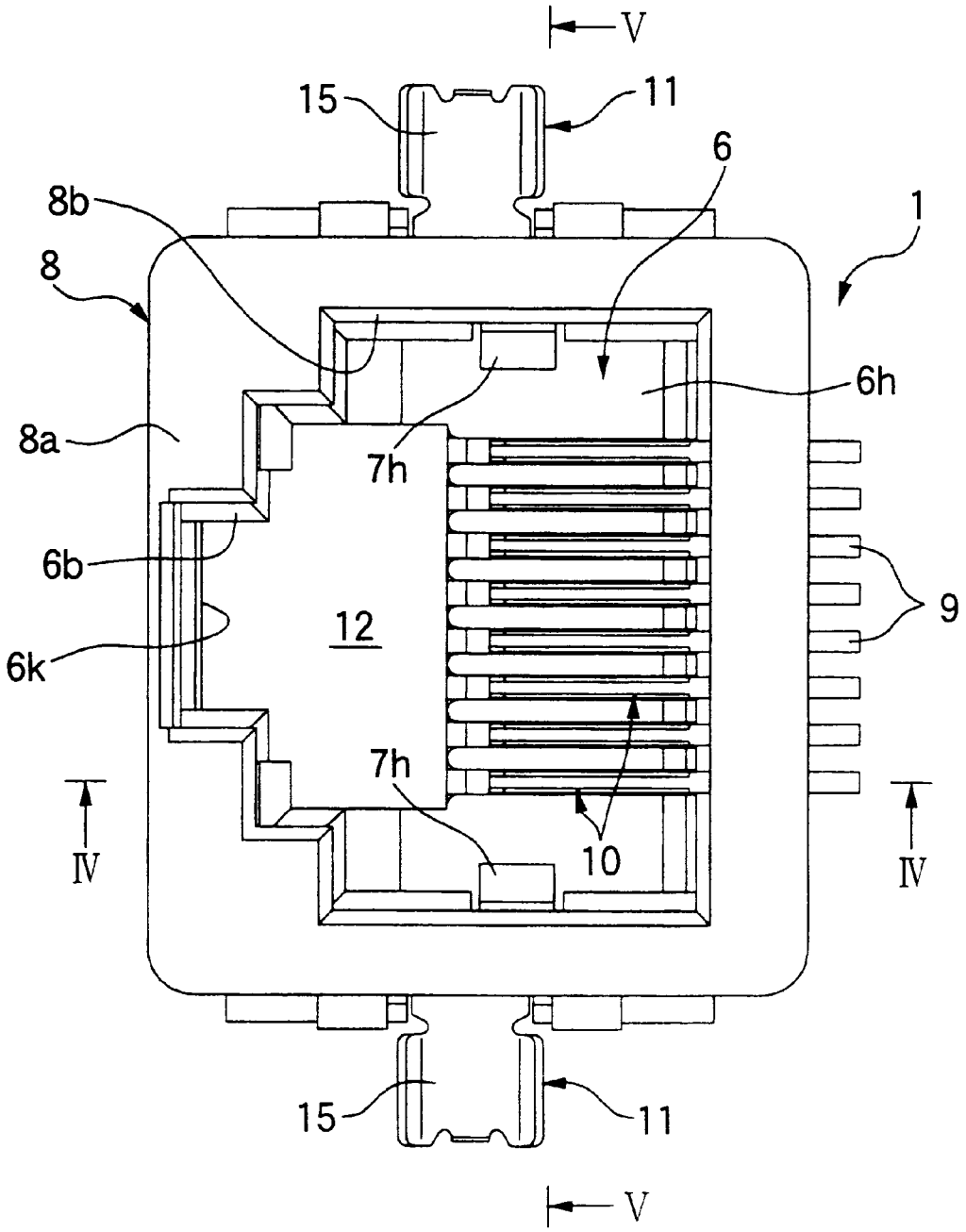
FIG. 3 is a plane view of the modular jack.
Figure 4:
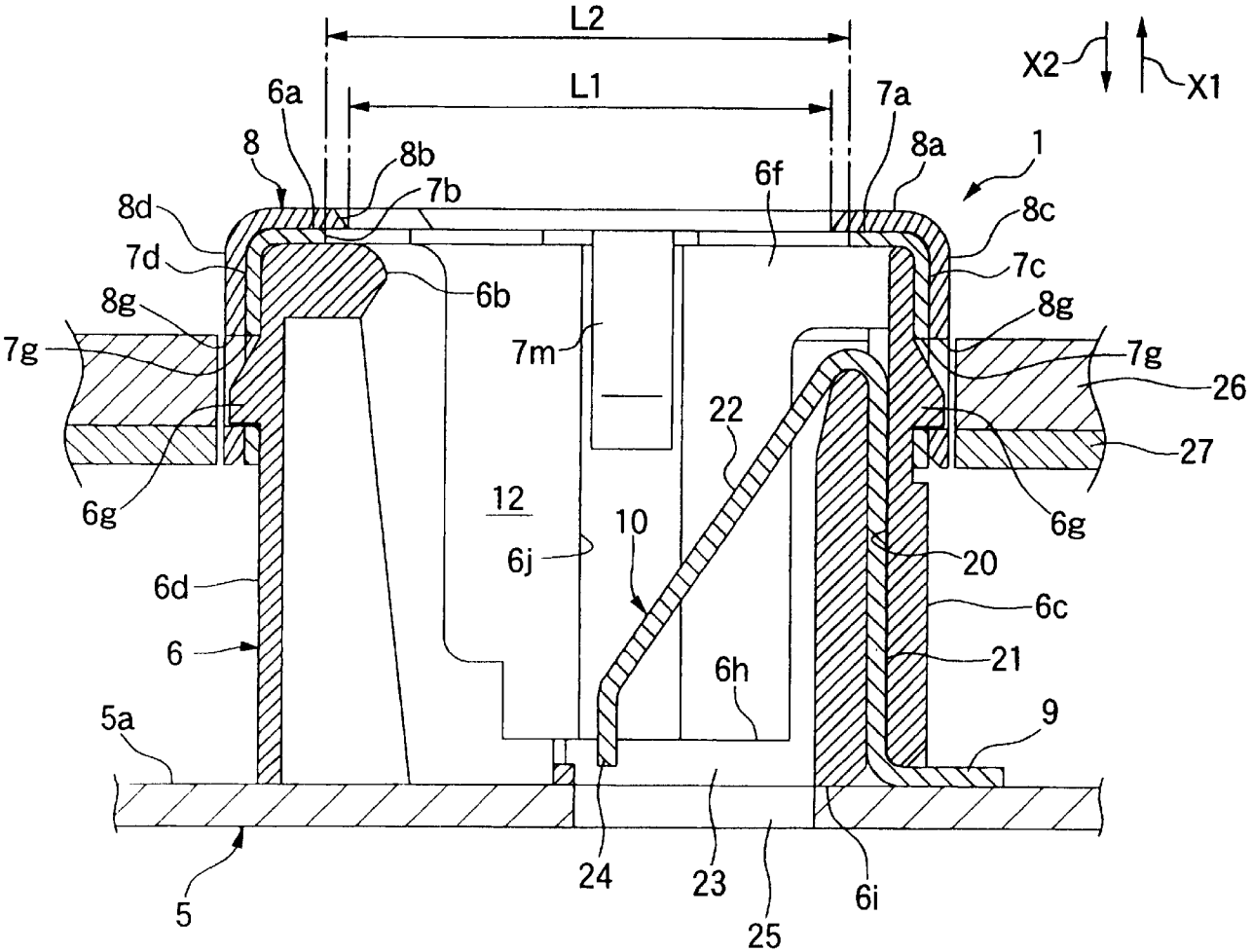
FIG. 4 is a sectional view taken along a line IV—IV of FIG. 3.
Figure 5:
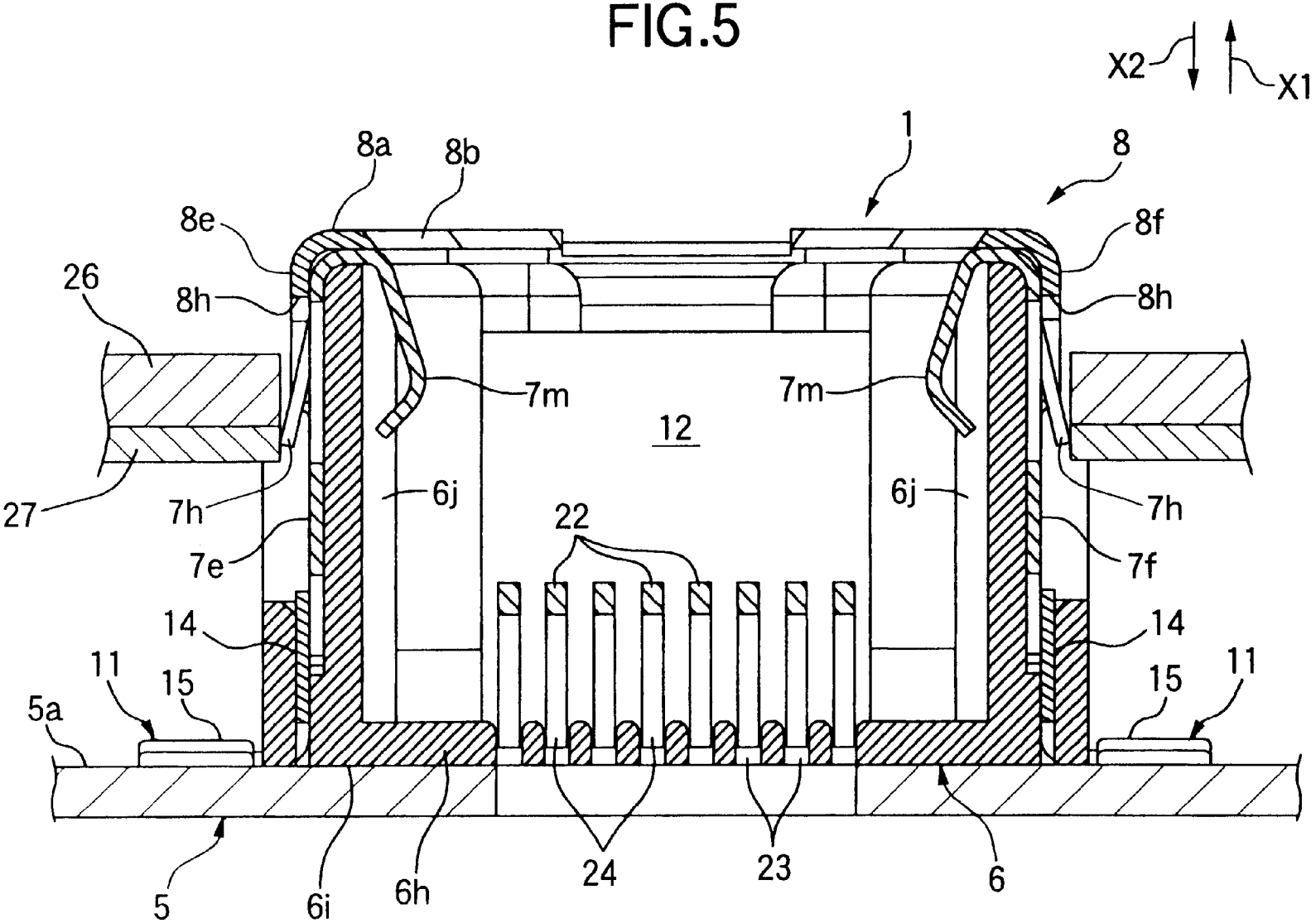
FIG. 5 is a sectional view taken along a line V—V of FIG. 3.
Figure 6:
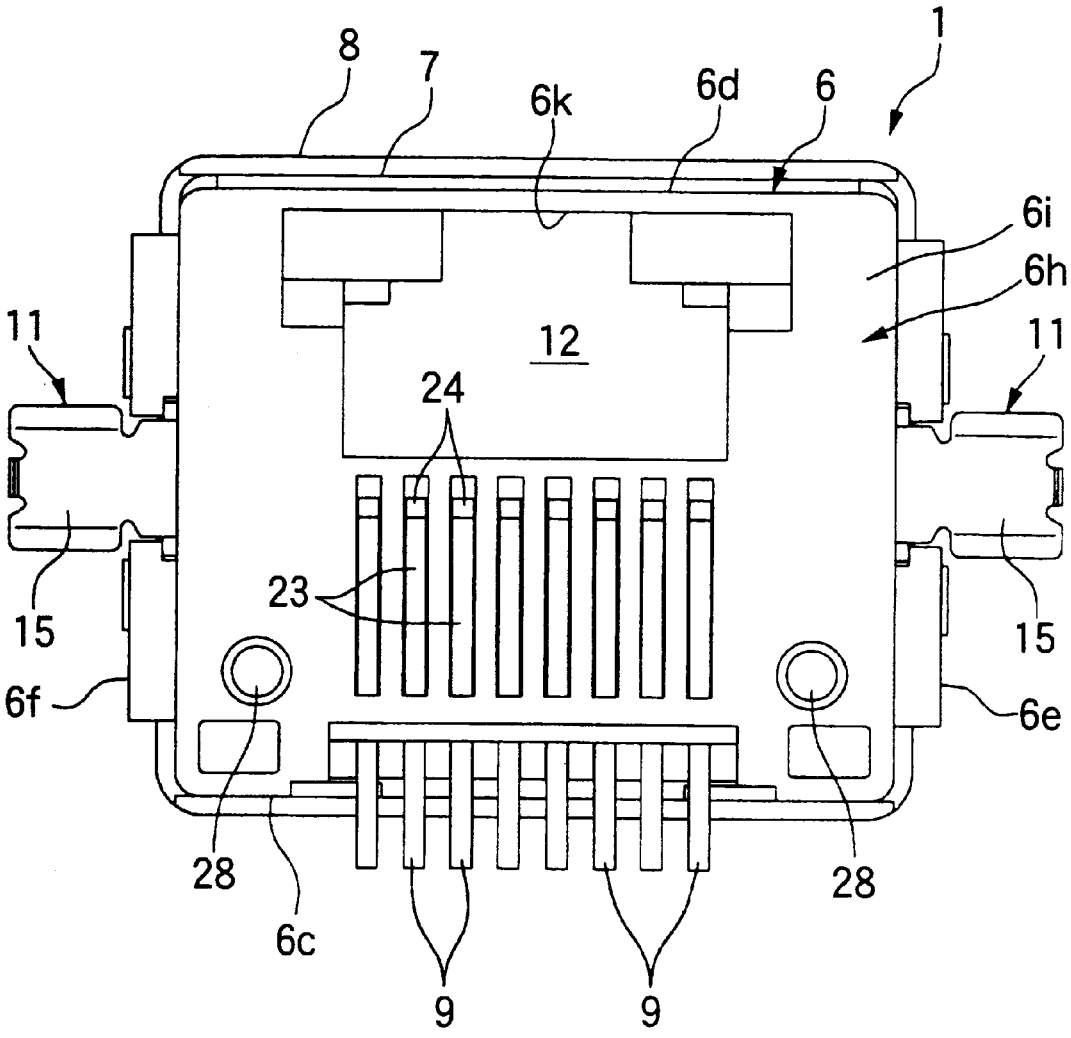
FIG. 6 is a rear view of the modular jack.

FIG. 2 is a disassembled perspective view of the modular jack, FIG. 3 is a plane view of the modular jack, FIG. 4 is a sectional view taken along a line IV—IV of FIG. 3, FIG. 5 is a sectional view taken along a ling V—V of FIG. 3, and FIG. 6 is a rear view of the modular jack.

Figure 10:
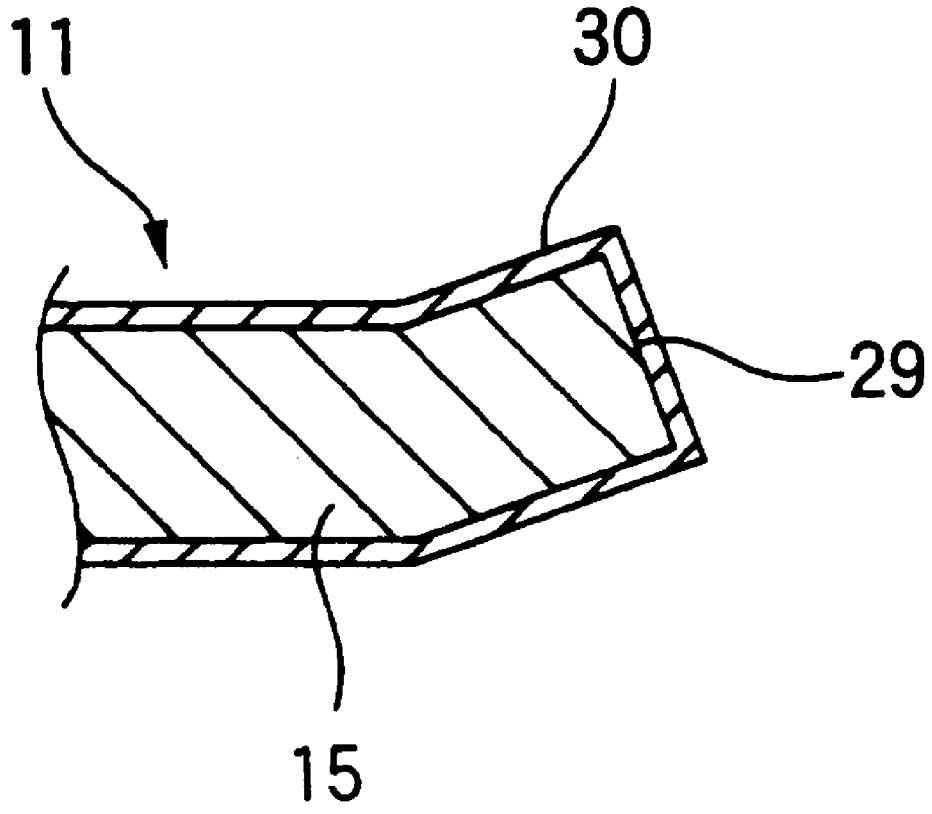
FIG. 10 is a sectional view of a leg portion of the reinforcement tab.

The main characteristic of the embodiment resides in that by constituting the metal shell 7 and the reinforcement tab 11 by separate members, the reinforcement tab 11 is constituted by a simple small-sized part to thereby enable to carry out plating after pressing. Thereby, as shown by FIG. 10, a rupture face 29 in pressing is coated by a plated coating 30 and therefore, solder wettability in soldering is improved to thereby enable to achieve fixing with certainty.

In reference to FIG. 2, FIG. 4 and FIG. 5, the casing 6 is provided with an insertion recessed portion 12 opened in the upper direction X1 via an insertion opening 6*b* formed at a front face 6*a* thereof, and the modular plug 2 is inserted into the insertion recessed portion 12 to thereby connect thereto electrically and mechanically. In reference to FIG. 4 and FIG. 6, a rear face 6*i* of the casing 6 constitutes an attaching face opposed to a surface 5*a* of the printed wiring board 5.

Figure 8:
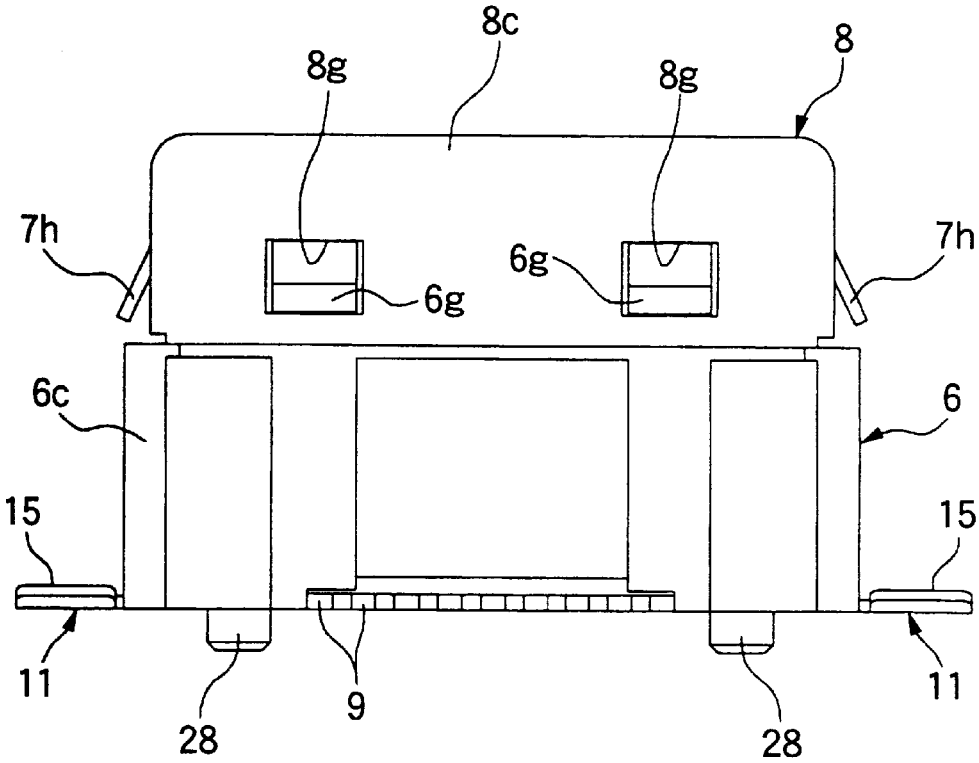
FIG. 8 is a side view of the modular jack.

In reference to FIG. 6, the rear face 6*i* of the case 6 is formed with an opening portion 6*k*. The opening portion 6*k* permits to introduce a base end portion (not illustrated) of the engaging lever 4 of the module plug 2 disposed at a mostly push-in position at inside of the insertion recessed portion 12 of the modular jack 1 to thereby minimize a depth dimension of the modular jack 1 and contribute to low back formation. In reference to FIG. 6 and FIG. 8, numeral 28 designates a rib inserted into an insertion hole (not illustrated) formed at the printed wiring board 5 for positioning the casing 6 to the printed wiring board 5.

In reference to FIG. 2 through FIG. 5, the shell 7 includes a front plate 7*a* having a rectangular contour for covering the front face 6*a* of the casing 6, and the insertion opening 7*b* for the modular plug communicating with the insertion recess portion 12 is partitioned at the front plate 7*a*. Side walls 7*c*, 7*d*, 7*e* and 7*f* respectively provided along corresponding side walls 6*c*, 6*d*, 6*e* and 6*f* of the casing 6, are extended from four sides of the front plate 7*a*. Further, elastic contact pieces 7*m* constituting a mountain shape, are respectively extended from a pair of opposed edge portions of the insertion opening 7*b* toward inside of the insertion recessed portion 12. In reference to FIG. 2 and FIG. 5, guide grooves 6*j* having a long vertical length for guiding the corresponding elastic contact pieces 7*m*, are formed at inner faces of the side walls 6*e* and 6*f* of the casing 6 (In FIG. 2, only the guide groove 6*j* of the side wall 6*f* is shown.). The respective elastic contact pieces 7*m* are for connecting to a metal shell (not illustrated) of the modular plug 2 to thereby connect to the ground. The shell is totally formed of sheet metal.

In reference to FIG. 2 and FIG. 4, left and right pairs of engaging holes 7*g* constituting, for example, a rectangular shape, are formed at the opposed side walls 7*c* and 7*d* of the shell 7. As shown by FIG. 2, the shell 7 is mounted to the casing 6 to cover the casing 6 from the upper side in the lower direction X2 and at this occasion, as shown by FIG. 4, the shell 7 is locked to the casing 6 by engaging locking projections 6*g* formed at the corresponding side walls 6*c* and 6*d* of the casing 6, with the respective engaging holes 7*g*.

In reference to FIG. 2 and FIG. 5, left and right pairs of window portions are formed at the opposed side walls 7*e* and 7*f* of the shell 7, and elastic contact pieces 7*h* are cut to rise in the respective window portions (in FIG. 2, only the elastic contact pieces 7*h* of the side wall 7*e* are shown) . As shown by FIG. 5, the elastic contact piece 7*h* is brought into elastic contact with a chassis 27 made of a metal provided along a rear face of a cabinet 26 made of synthetic resin of an apparatus for operating to electrically conduct the shell 7 with the chassis 27 and match the ground level.

In reference to FIG. 1, there are formed first extended portions 7*i* extended from central portions of the respective side walls 7*e* and 7*f* in the lower direction X2 (side of the printed wiring board 5) and there are further formed second extended portions 7*j* extended from central portions of the first extended portions 7*i* in the lower direction X2.

A pair of side portions of the first extended portions 7*i* are respectively fitted to a pair of groove portions 13 formed at the side walls 6*e* and 6*f* of the casing 6 to respectively open in the upward direction X1 and in inward side directions. The second extended portions 7*j* are fitted to groove portions 17 formed between side plates 14 of the corresponding reinforcement tabs 11 and the corresponding side walls 6*e* and 6*f* of the casing 6.

Figure 9:
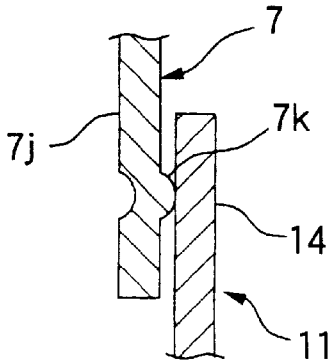
FIG. 9 is a sectional view of a side wall of a shell and a side plate of a reinforcement tab engaged with each other.

In reference to FIG. 1 and FIG. 9, an outer side face of the second extended portion 7*j*, is formed with an engaging projection 7*k* engaged with a back face of the side plate 14 of the reinforcement tab 11.

In reference to FIG. 1, the reinforcement tab 11 is constituted by pressing a conductive sheet metal member. The reinforcement tab 11 is constituted by carrying out plating of, for example, tin plating or the like after pressing, and as shown by FIG. 10, its surface is covered by the conductive plated coating 30. The reinforcement tab 11 is provided with the side plate 14 and a leg portion 15 in a plate-like shape extended outwardly and orthogonally from a lower end of the side plate 14. Arm portions 16 are extended from upper portions of a pair of side portions of the side plate 14 to both sides, thereby, the side plate 14 is constituted by substantially a T-like shape.

According to the respective reinforcement tabs 11, the side plates 14 are fitted to the pair of groove portions 17 of the corresponding side walls 6*e* and 6*f* by moving the side plates 14 from the upper side in the lower direction X2 along central portions of the side wails 6*e* and 6*f* of the shell 7 previously mounted to the casing 6. At this time, the arm portions 16 of the side plate 14 are brought into contact with positioning stepped portions 18 in the groove portion 17 to thereby position a height position of the reinforcement tab 11. Press-fitting projections 19 are formed at side edges downward from the respective arm portions 16 of the side plate 14. The respective press-fitting projections 19 are press-fitted to corresponding groove walls of the groove portion 17 to thereby lock the side plate 14 from being drawn in the upper direction X1. As shown by FIG. 9, the engaging projection 7*k* of the shell 7 is brought into press contact with the side plate 14 of the reinforcement tab 11 prevented from drawing in this way to thereby ensure to prevent the shell 7 from being drawn in the upward direction.

In reference to FIG. 3 and FIG. 4, the side wall 6*c* holds the plurality of contact pins 10 to align horizontally. Specifically, each of the contact pins 10 is provided with a fixed portion 21 fixedly inserted to a fixing hole 20 penetrating the side wall 6*c* in the up and down direction, an elastic contact portion 22 in a cantilever shape bent to constitute an acute angle from an upper end of the fixed portion 21 and extended in an inclined shape toward the side of the printed wiring board 5 on the lower side and the lead portion 9 bent to constitute substantially right angle from a lower end of the fixed portion 21 and projected to an outer side of the side wall 6*c* along the surface 5*a* of the printed wiring board 5.

Meanwhile, as shown by FIG. 4, FIG. 5 and FIG. 6, at a rear wall 6*h* forming a rear face 6*i* of the casing 6, there are formed a plurality of slits 23 in parallel with each other as lead-out openings for opening the insertion recessed portion 12 to the side of the printed wiring board 5 on the rear side. The slits 23 as the lead-out openings are slidably fitted with front ends 24 of the corresponding elastic contact portions 22.

Figure 7:
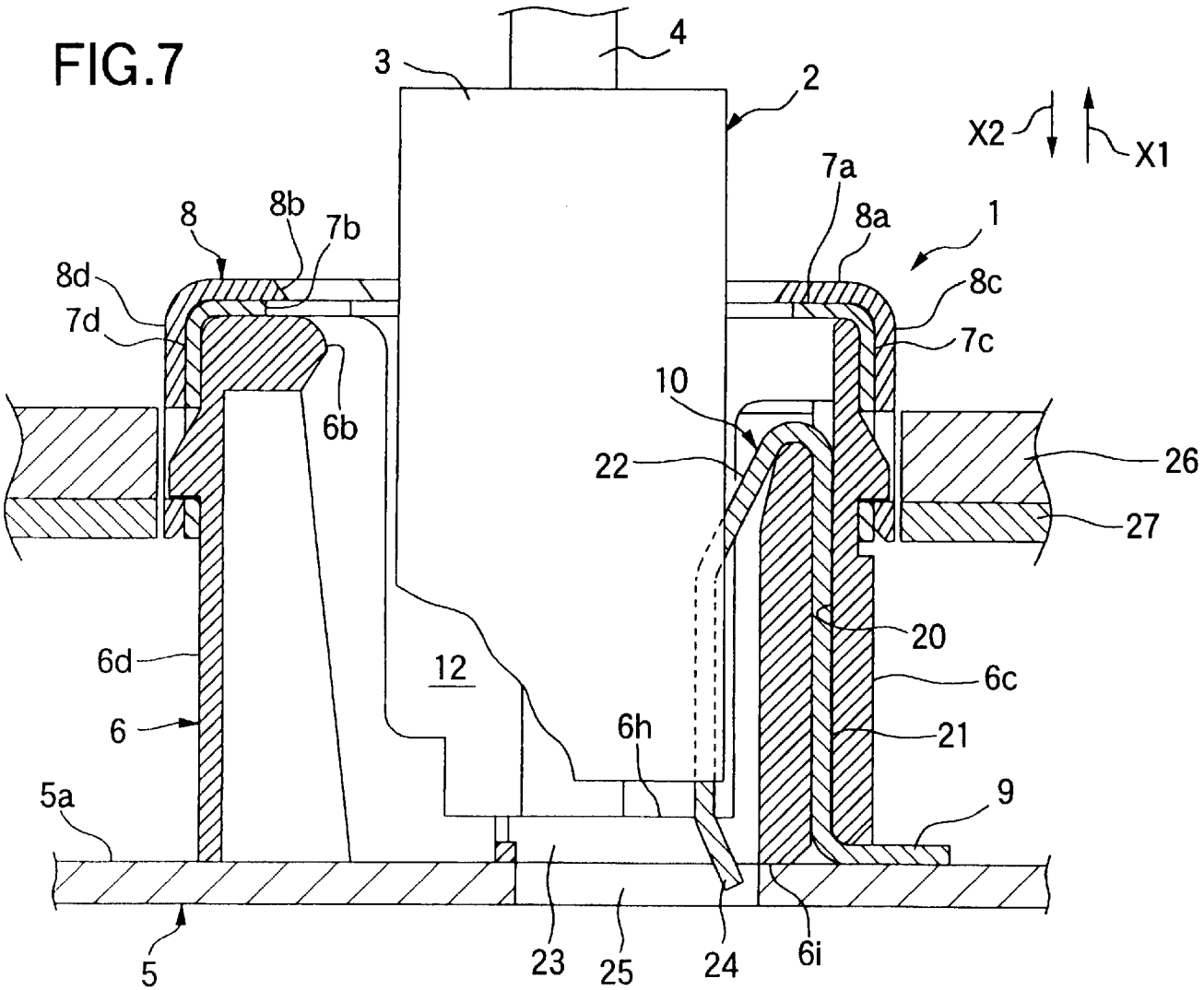
FIG. 7 is an outline sectional view of the modular jack in a state of being connected to the modular plug.

As shown by FIG. 7, when the modular jack 1 is connected with the modular plug 2 and the respective elastic contact portions 22 are bent, the front ends 24 of the elastic contact portions 22 are projected to the rear side of the casing 6 via the slits 23. The printed wiring board 5 is formed with through holes 25 substantially in a rectangular shape as escapement for permitting the front ends 24 of the plurality of the elastic contact portions 22 to project to the rear side of the casing 6. The slits 23 guide the front ends 24 of the elastic contact portions 22 to smoothly dislocate when the front ends 24 of the elastic contact portions 22 are deformed to bend.

In reference to FIG. 2 through FIG. 5, the insulating cover 8 is provided with a front plate 8*a* having the insertion opening 8*b* and having substantially a rectangular contour and four side walls 8*c*, 8*d*, 8*e* and 8*f* extended from four sides of the front plate 8*a* and constituting a square ring shape.

In reference to FIG. 4, the insertion opening 8*b* of the insulating cover 8 is formed by a similar shape slightly smaller than the insertion opening 7*b* of the shell 7 (opening diameter L1<L2), as a result, the edge portion of the insertion opening 7*b* of the shell 7 is prevented from being exposed by the edge portion of the insertion opening 8*b* of the insulating cover 8.

The respective side walls 8*c* through 8*f* of the insulating cover 8 are made to cover the corresponding side walls 7*c* through 7*f* of the shell 7. Ranges of the respective side walls 8*c* through 8*f* of the insulating cover 8 of covering the corresponding side walls 7*c* through 7*f* of the shell 7, correspond to ranges of exposing the shell 7 from the cabinet 26 of the apparatus in a state in which the modular jack 1 is actually attached to the apparatus as shown by FIG. 4 and FIG. 5. An exposed portion of the shell 7 is covered by the insulating cover 8 and its appearance is excellent. Further, a foreign matter is prevented from being brought into contact with the exposed portion and electromagnetic shielding is ensured.

In reference to FIG. 2 and FIG. 5, the side walls 8*e* and 8*f* are formed with cutout portions 8*h* as escapement for preventing interference with the respective elastic contact pieces 7*h* of the shell 7.

Meanwhile, in reference to FIG. 2 and FIG. 4, the side walls 8*c* and 8*d* are formed with respective pairs of engaging holes 8g for engaging with the locking projections 6*g* of the casing 6 projected from the engaging holes 7*g* of the shell 7. By the engagement, there is achieved to prevent the insulating cover 8 from drawing from the shell 7. The locking projections 6*g* of the casing 6 achieve to unitarily lock the shell 7 and the insulating cover 8 to thereby achieve to prevent from being drawn, and the structure can be simplified.

According to the embodiment, the reinforcement tab 11 can be constituted by a part having a simple structure separately from the shell 7 and accordingly, even when plating is carried out after pressing (post plating), pressed products are not tangled with each other in a plating tank. Therefore, so-to-speak post plating can be carried out without lowering operational efficiency in plating.

By carrying out post plating of the reinforcment tab 11, as shown by FIG. 10, for example, the rupture face 29 in pressing the leg portion 15 is covered by the plated coating 30 and therefore, as a result of improving wettability of solder at the portion, the reinforcement tab 11 is fixed with certainty.

Further, the shell 7 and the reinforcement tab 11 are engaged with each other to thereby ensure electric conduction, and the shell 7 is connected to the chassis 27 of the apparatus. Furthermore, the reinforcement tab 11 is connected to the printed wiring board 5. Accordingly, a ground through path for matching ground levels of the chassis 7 and the printed wiring board 5 can be achieved by a simple structure by way of the shell 7 and the reinforcement tab 11.

Further, the shell 7 can be prevented from being drawn from the casing 6 with certainty by the reinforcement tab 11.

Further, by bringing the respective elastic contact pieces 7*k* and 7*m* of the shell 7 into contact with a shell of the modular plug 2 and the chassis 27 of the apparatus, contact for grounding can easily be carried out.

Figure 11:
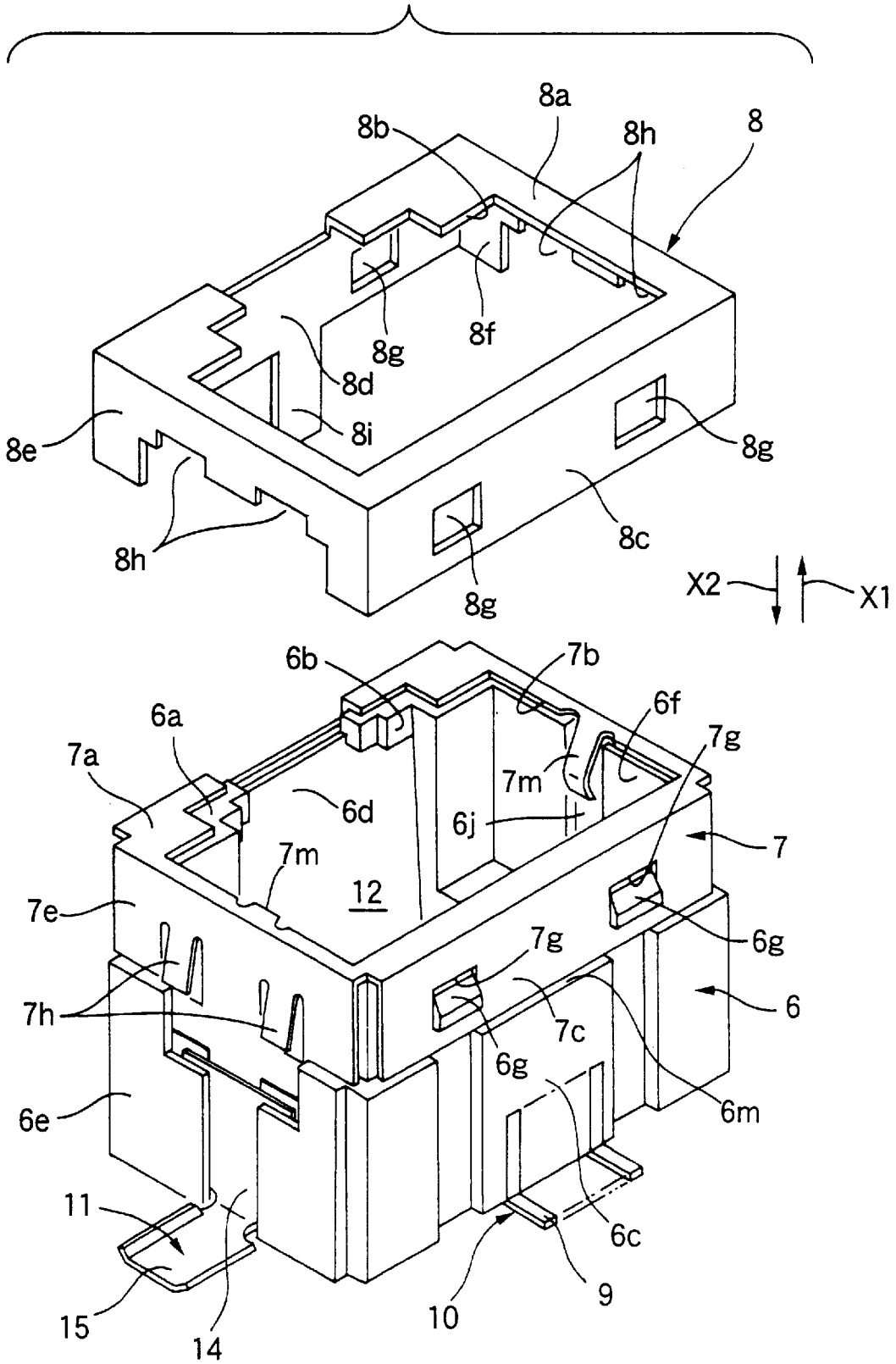
FIG. 11 is a disassembled perspective view of a modular jack according to another embodiment of the invention.

Further, the invention is not limited to the above-described embodiment but, for example, as shown by FIG. 11, an inverse insertion preventive portion 8*i* extended in the lower direction may be extended from the side wall 8*d* of the insulating cover 8. In this case, when the direction of the insulating cover 8 is assumedly changed from a regular direction by 180 degrees and the side wall 8*d* of the insulating cover is going to cover the side wall 7*c* of the shell 7, a lower end of the inverse insertion preventive portion 8*i* is brought into contact with a stepped portion 6*m* of the side wall 6*c* of the casing 6. Thereby, mounting of the insulating cover 8 is hampered and therefore, assembly by so-to-speak inverse insertion cannot be carried out. In the embodiment of FIG. 11, constitutions similar to those of FIG. 2 are attached with similar notations and an explanation thereof is omitted.

Figure 12:
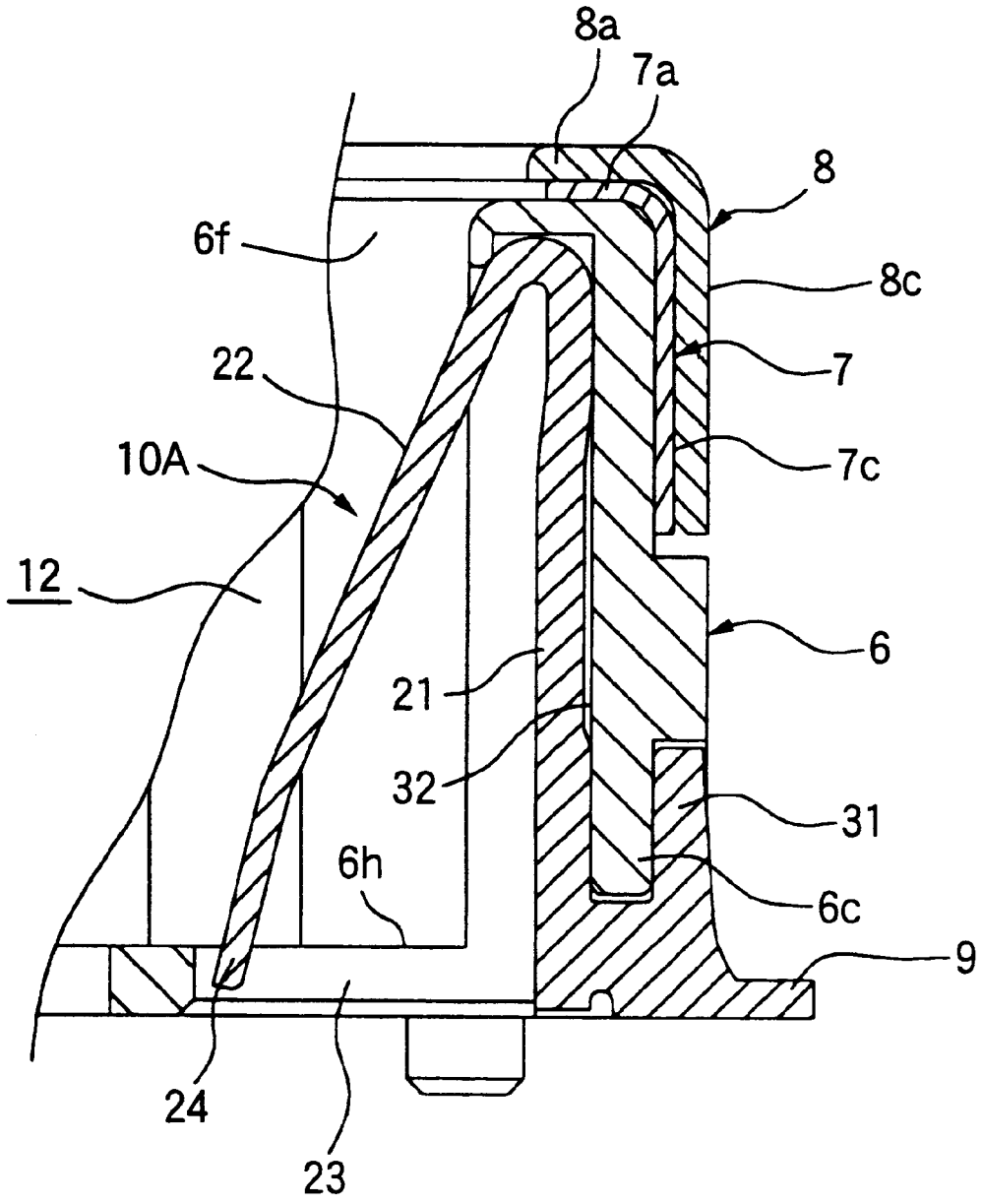
FIG. 12 is a sectional view of a modular jack according to still another embodiment of the invention.

Further, as shown by FIG. 12, there may be constructed a structure in which there is provided an attached piece 31 extended from a lead 9 of a contact pin 10A in parallel with the fixed portion 21 and a lower portion of the side wall 6*c* is sandwiched by the fixed portion 21 and the attached piece 31 to thereby fix the contact pin 10A to the casing 6. Although according to the embodiment of FIG. 4, the fixed portion 21 is inserted into the fixing hole 20 of the casing 6, in this embodiment, the fixed portion 21 is mounted to a holding groove 32 opened to inside of the casing 6 and the lower side of the casing 6. The holding groove 32 communicates with the slit 23. In this embodiment, assembling can easily be carried out by mounting the contact pin 10A from the lower side of the casing 6. That is, the elastic contact portion 22 and the fixed portion 21 of the contact pin 10A are inserted into the casing 6 via the slit 23, and the lower portion of the side wall 6*c* of the casing 6 is press-fitted into a space between the fixed portion 21 and the attached piece 31 to thereby fix thereto. In the embodiment of FIG. 12, constitutions similar to those of the embodiment of FIG. 4 are attached with similar notations.

Otherwise, various changes can be carried out within the range of the invention.

What is claimed is:

1. A modular jack comprising:

an insulating casing arranged on a printed wiring board;

a metallic reinforcement tab configured to fix the insulating casing to the printed wiring board and including, a side plate configured to be inserted along a side wall of the insulating casing, and a leg portion extending from the side plate along a surface of the printed wiring board and soldered to a conductive portion of the surface of the printed wiring board; and a metallic shell configured to electromagnetically shield the insulating casing and having an extended portion configured to engage with the side plate of the metallic tab in a groove portion of the insulating casing, wherein at least one of the extended portion of the metallic shield and the side plate of the metallic reinforcement tab includes an engaging portion configured to electrically contact the other of the extended portion of the metallic shell and the side plate of the metallic reinforcement tab, and the metallic reinforcement tab is configured to engage the extended portion of the metallic shell on an interior of the side plate of the metallic tab facing a center of the metallic shell.

2. The modular jack according to claim 1, wherein the engaging portion comprises:

an engaging projected portion formed at one of the extended portion of the metallic shell and the side plate of the reinforcement tab and engaged with the other thereof to thereby prevent the metallic shell from being detached from the insulating casing.

3. The modular jack according to claim 1, wherein the extended portion comprises an elastic piece for grounding.

4. The modular jack according to claim 2, wherein the extended portion comprises an elastic piece for grounding.

5. The modular jack according to claim 1, wherein the metallic reinforcement tab comprises a pressed product having a conductive plated coating.

* * * * *